United States Patent [19]

Takeda et al.

[11] Patent Number: 4,690,346

[45] Date of Patent: Sep. 1, 1987

[54] TAPE WINDING MACHINE

[75] Inventors: Kyoji Takeda; Akira Kitai, both of Tokyo, Japan

[73] Assignee: Tanaka Seiki Co., Ltd., Tokyo, Japan

[21] Appl. No.: 821,540

[22] Filed: Jan. 22, 1986

[30] Foreign Application Priority Data

Jan. 25, 1985 [JP] Japan ..... 60-8787[U]

[51] Int. Cl.[4] ..... B65B 11/04

[52] U.S. Cl. ..... 242/56 R; 53/214; 53/587; 242/64

[58] Field of Search ..... 242/56 R, 56 A, 64; 53/211, 214, 582, 587

[56] References Cited

U.S. PATENT DOCUMENTS

| | | | |
|---|---|---|---|
| 3,137,451 | 6/1964 | Spanke | 53/214 X |
| 3,407,565 | 10/1968 | Bender et al. | 53/214 |
| 3,472,462 | 10/1969 | Young | 242/56 A |
| 3,784,122 | 1/1974 | Kataoka | 242/64 X |
| 3,799,469 | 3/1974 | Oga et al. | 242/64 X |
| 4,597,316 | 7/1986 | Ichikawa | 242/64 X |

FOREIGN PATENT DOCUMENTS

| | | | |
|---|---|---|---|
| 88314 | 9/1983 | European Pat. Off. | 242/56 R |

*Primary Examiner*—Daniel P. Stodola
*Attorney, Agent, or Firm*—Spencer & Frank

[57] ABSTRACT

A spindle supports a wound coil. On a base movable in a plane perpendicular to the spindle are supported a pad, a cutter and a tape table bearing on it a plurality of tapes. Tape is wound around the coil by the rotation of the spindle, and the cutter provided in the vicinity of the pad moves back and forth, while being pushed by the pad, to cut the end of the tape after completion of the tape winding. Tapes may be exchanged automatically when one tape is exhausted.

2 Claims, 7 Drawing Figures

TAPE WINDING MACHINE

BACKGROUND OF THE INVENTION

This invention relates to a tape winder for a coil and more particularly to a tape winder which can automatically wind a covering tape around the wound out coil.

Coil winding has been made automatic by automatic coil winding machines, which have greatly improved the efficiency of the coil winding operation. However, the cover tape winding operation around finished coils has still been carried out only by hand.

For this reason, though the coil winding work has already been improved very much, fully automatic coil manufacture and improvement of efficiency in such work could not have been expected due to this fully manual tape winding operation around the coil.

An objective of the present invention is therefore to provide an automatic tape winding machine for an already wound coil.

Another objective of the present invention is to provide a tape winding machine which can automatically exchange tape.

SUMMARY OF THE INVENTION

The tape windng machine according to this invention comprises a spindle rotating as it supports a wound coil; a base movable in a plane perpendicular to the spindle; a pad supported by the base; a cutter provided in the vicinity of the pad and movable back and forth and a tape table rotatably provided on the base and supporting a plurality of tapes.

PREFERRED EMBODIMENTS

Figure 1:
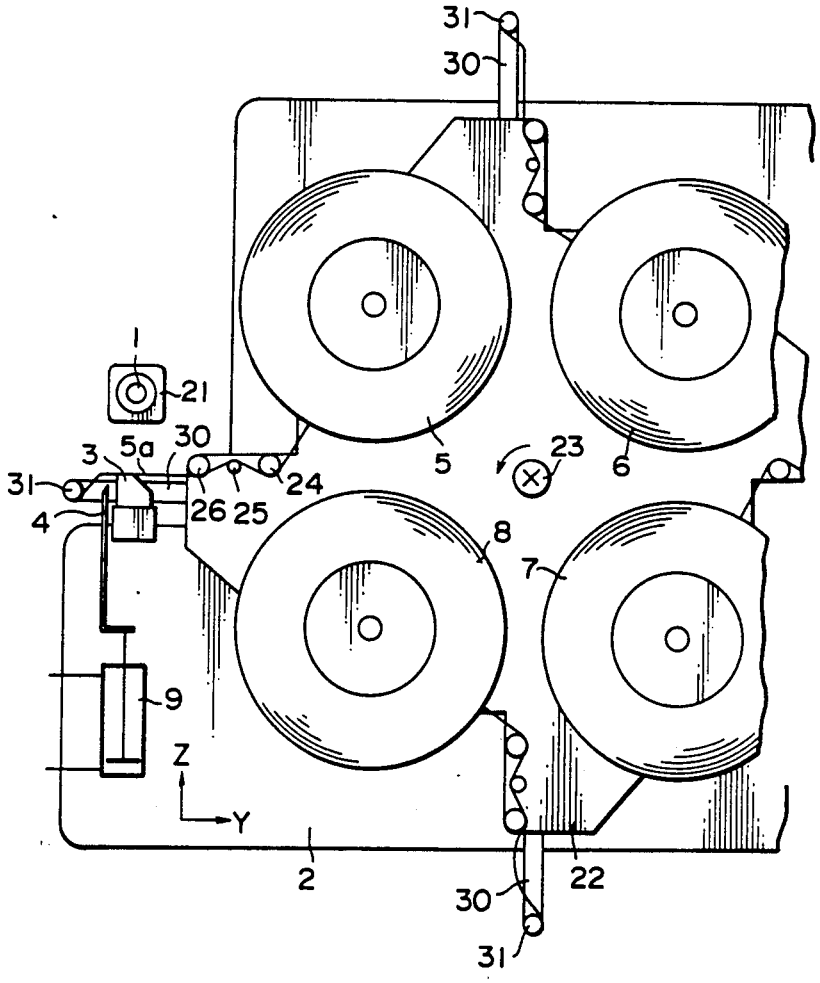
FIG. 1 is a schematic view of the entire structure of an embodiment of the tape winding machine according to this invention.

An embodiment of the tape winding machine according to the present invention will now be explained in detail with reference to the attached drawings.

A spindle 1 is a rotatable axle supporting an already wound coil 21. The number of rotations of the spindle 1 may be set with a dial, not shown, usually between one to three rotations. If required, however, other numbers of rotations may be set, for example, 1.5 or 6 rotations.

A base 2 is movable in a plane perpendicular to the rotating axle of the spindle 1 (the X coordinate) in the directions of the Y and Z coordinates by a driving mechanism, not shown. A pad 3 is provided on the base 2, and its function is to stick an end portion 5*a* of tape 5 on the coil 21 supported on the spindle 1. Near the pad 3, a cutter 4 is provided and it cuts the tape 5 after the tape 5 is wound around the coil for the set number of turns. The cutter 4 is driven by an air cylinder 9 provided on the base 2.

Figure 2A:
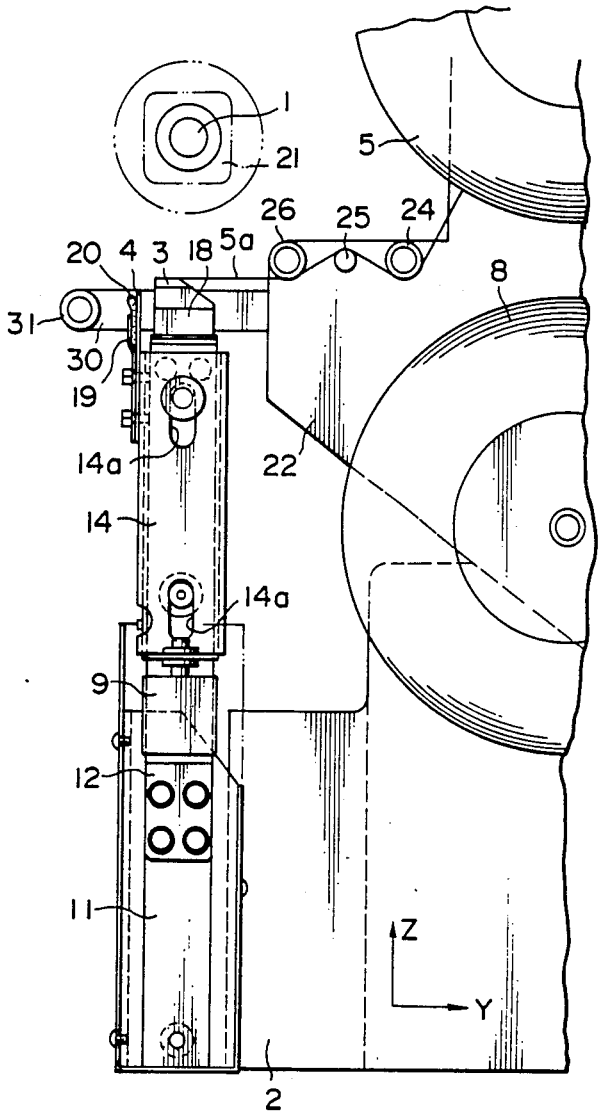
FIG. 2(A) is a front view of the pad and the cutter portions of the embodiment shown in FIG. 1.
Figure 2B:
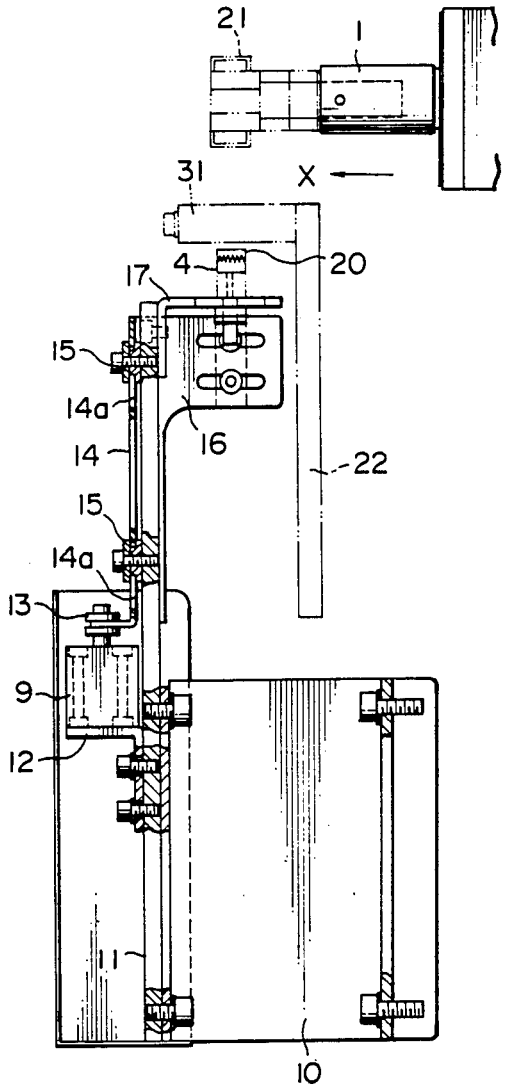
FIG. 2(B) is its side view.

As shown in FIGS. 2(A) and 2(B), a main pole 11 is mounted on the base 2 through a mounting stand 10, while the air cylinder 9 is mounted on the main pole 11 by means of a mounting plate 12. To the rod of the air cylinder 9 a sliding plate 14 is mounted through a connecting piece 13. Slots 14*a*, 14*a* are provided in the sliding plate 14 so that the plate 14 may be slidably mounted on the main pole 11 by sliding pieces 15,15. On the other hand, the cutter 4 is mounted on the sliding plate 14 through a cutter holder 16.

A pad stand 18 is mounted on the main pole 11 through a push arm 17, while the pad 3 is mounted on the pad stand 18.

At the rear side of the cutter 4 a rubber pad 20 is held by a push plate 19. After the cover tape is wound around the coil 21, the rubber pad 20 pushes the wound tape when the spindle 1 rotates, so that the tape is firmly stuck around the outer surface of the coil 21.

A tape table 22 is mounted on the base 2 and is rotatable about an axle 23, as fully realized by FIG. 1. Four rolls of tape 5, 6, 7 and 8 are supported in this embodiment by the tape table 22. In the figure, the tape from roll 5 is fed through rollers 24, 25, and 26 provided on the tape table 22. Its end is at first drawn beyond the position of pad 3 and stuck to an axle 31 provided on an arm 30. The rolls of tape 6, 7 and 8 are likewise drawn out by and through the like rollers, and respectively stuck to the arm 30 and axle 31 provided for each tape.

The operation of an embodiment of the tape winding machine according to this invention is now explained referring to FIGS. 3(A), 3(B), 3(C) and 3(D).

The wound coil 21 is mounted on the spindle 1 and the covering tape winding operation is started by pushing a switch button, not shown. At this stage, the pad 3 is disposed on a line perpendicular to the central axle of the spindle as shown in FIGS. 2(A) and 2(B), while the end 5*a* of the tape 5 is fully drawn beyond the position of the pad 3.

Figure 3A:
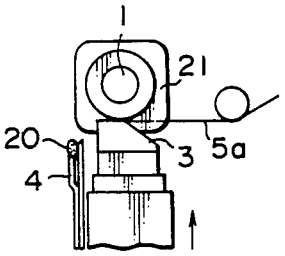
FIGS. 3(A), 3(B), 3(C) and 3(D) are views for explaining the operation of an embodiment of the tape winding machine for a coil.

The base 2 is moved in the direction of the Z coordinate, so that the pad 3 makes the end 5*a* attach to the outer winding of the coil 21 as shown in FIG. 3(A).

Figure 3B:
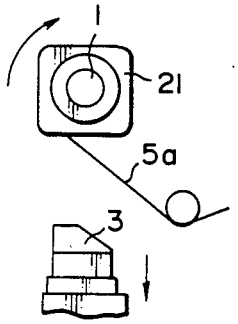
Figure 3C:
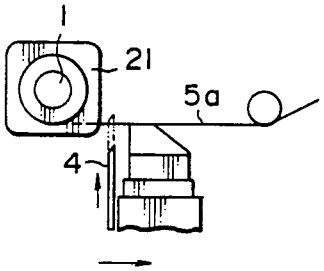

As the pad 3 retreats, the spindle 1 rotates in the clockwise direction shown by an arrow in FIG. 3(B), to wind the tape 5 around the outer surface of the winding 21*a* of the coil 21, as shown in FIG. 3(B).

After rotating through the set number of rotations, the spindle 1 stops. Then the base 2 moves in the direction of the Y coordinate up to the position of FIG. 3(C). At this stage, air pressure is applied to the air cylinder 9 and the cutter 4 moves to the position shown in a broken line of FIG. 3(C) through the slide plate 14 shown in FIGS. 2(A) and 2(B) to cut the tape 5.

Figure 3D:
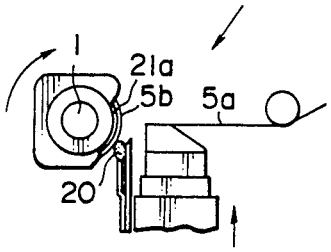

After the tape 5 is cut, the base 2 moves in the Z direction to push the rubber pad 20 onto the tape 5*b* wound around the outer surface of the winding 21*a*, as shown in FIG. 3(D). At this stage, the spindle 1 is rotated for some number of turns to push the tape 5*b* on the winding 21*a*.

After the completion of the above tape winding operation, the base 2 returns to its initial position and the coil 21 is automatically removed from the spindle 1. When the tape 5 is exhausted, the tape table 22 rotates in the anticlockwise direction of FIG. 1 and the next tape 6 may be used. Likewise, the tapes 7 and 8 are successively used when the tape 6 is exhausted. By exchanging the exhausted tapes, the operation may be made continuous. In the embodiment shown, four tapes are supported on the tape table 22, but it will be understood that continuous operation is possible with a plurality of tapes.

As described above, according to the tape winding machine of this invention, when a coil is mounted on the spindle, the base moves automatically; the tape is stuck to the coil by the pad; and the tape is wound around the coil by the rotation of the spindle. The tape is then cut by a cutter. Thus a completely automatic tape winding operation is possible.

The tape winding machine according to this invention is rather small in size, and so it can be placed near the coil winding machine, so that the tape winding operation may be carried out continuously after the coil winding.

Since a plurality of tapes may be placed on the tape table, a continuous tape winding may be possible. Any desirable number of tapes of different colors, thickness, etc. may be wound continuously without exchanging the tape.

What is claimed is:

1. A tape winding machine for winding an adhesive cover tape around a wound coil mounted on a rotable spindle, said spindle having an axis extending in a first direction, comprising:

a base movable in second and third orthogonal directions, said second and third directions being perpendicular to said first direction;

a tape table rotatably supported on said base, said tape table supporting a plurality of rolls of said adhesive cover tape and being rotatable about an axis extending in said first direction;

tape mechanism means for withdrawing said cover tape from one said plurality of rolls of tape, said means including a plurality of arms extending from said tape table, one of said arms being associated with each of said rolls of cover tape;

an axle secured to the end of each of said arms, each of said axles being rotatable about an axis extending in said first direction; and at least one roller rotatable about an axis extending in said first direction interposed between said axle and its associated roll of cover tape, the end of a cover tape being withdrawable from a selected roll of tape and stuck to the axle associated with said selected roll of tape;

a pad supported by said base for movement in said second direction, said pad having a surface contacting said tape between said axle and said roller, the end of said tape being attached to the outer winding of said wound coil by movement of said pad in said second direction; and a cutter supported by said base adjacent to said pad for movements in said second and third directions, said cutter being moved in said third direction to a predetermined position after the end of said tape has been attached to said wound coil and in said second direction to cut said tape.

2. A tape winding machine according to claim 1 wherein a further pad is provided for pressing against the outer periphery of said wound coil after said tape has been cut and as said rotatable spindle is rotated, the pressure of said pad assuring adhesion of said cover tape to the outer surface of said coil.

* * * * *